US005752535A

United States Patent [19]

Sanders

[11] Patent Number: 5,752,535

[45] Date of Patent: May 19, 1998

[54] CRUTCH

[76] Inventor: Ward L. Sanders, 10827 Ivorary Rd., Albion, Pa. 16401

[21] Appl. No.: 727,826

[22] Filed: Sep. 23, 1996

[51] Int. Cl.[6] ..... A61H 3/02

[52] U.S. Cl. ..... 135/68; 135/71; 135/76; 135/86

[58] Field of Search ..... 135/65, 68, 69, 135/71, 72, 73, 75, 76, 77, 82, 84, 86

[56] References Cited

U.S. PATENT DOCUMENTS

| | | | |
|---|---|---|---|
| 1,266,936 | 5/1918 | Harris | 135/86 X |
| 1,323,532 | 12/1919 | Hoar | 135/77 X |
| 2,037,015 | 4/1936 | Fallon | 135/73 |
| 2,172,178 | 9/1939 | Rosenberg . | |
| 2,230,406 | 2/1941 | Johnson | 135/86 X |
| 2,383,786 | 8/1945 | Gish . | |
| 2,857,925 | 10/1958 | Higginbotham | 135/86 |
| 3,213,870 | 10/1965 | Kiehn | 135/68 |
| 3,417,765 | 12/1968 | Slator et al. | 135/72 X |
| 4,146,045 | 3/1979 | Grant | 135/66 |
| 4,289,156 | 9/1981 | Ulics | 135/66 |
| 4,295,483 | 10/1981 | Smith | 135/66 |
| 4,509,741 | 4/1985 | Smith | 135/69 X |
| 4,899,771 | 2/1990 | Wilkinson | 135/77 |
| 5,056,545 | 10/1991 | Spaeth | 135/66 |
| 5,101,845 | 4/1992 | Kravetz | 135/66 |
| 5,139,040 | 8/1992 | Kelly | 135/69 |
| 5,167,746 | 12/1992 | Sheenan | 135/77 X |
| 5,291,910 | 3/1994 | Bui et al. | 135/72 X |
| 5,307,828 | 5/1994 | Gardner et al. | 135/82 |
| 5,417,234 | 5/1995 | Davis | 135/68 |
| 5,482,070 | 1/1996 | Kelly . | |

FOREIGN PATENT DOCUMENTS

| | | | |
|---|---|---|---|
| 702634 | 1/1954 | United Kingdom | 135/68 |

*Primary Examiner*—Lanna Mai
*Attorney, Agent, or Firm*—Bilicki & Simpson, P.C.

[57] ABSTRACT

A crutch is disclosed for providing assistance to individuals who have been injured or are physically challenged. The crutch includes two members capable of telescoping adjustment to accommodate the height of a user. A special shoulder support is used to provide comfortable support to the underarm of the user. The crutch also includes a rectangular foot, which is used to provide a more secure contact with the ground. The foot is specially designed so that is may flex in a manner similar to that of a human foot. The crutch is also capable of supporting multiple accessory items such as a beverage container and a briefcase.

12 Claims, 3 Drawing Sheets

CRUTCH

BACKGROUND OF THE INVENTION

The present invention relates to crutches and more particularly to crutches capable of being adjusted. The invention is specifically concerned with those crutches which allow the user to attach accessories to the crutch.

Crutches have long been used as an ambulatory aid to assist injured or otherwise disabled persons in standing or walking. In most cases, crutches are used temporarily to provide mobility to the user. In the past, crutches have been designed to assist such persons with little or no regard for comfort. Such crutches have typically incorporated a "Y" frame design. Such a frame has two members that converge near the bottom and attach to a central leg member. The central leg member includes a rounded tip which makes contact with the ground. The two frame members are spread apart at the top to support an underarm brace. Horizontally opposing sets of holes in the frame members permit a handgrip to be attached between the frame members by a bolt and wingnut. A handgrip is provided which is vertically adjustable in order to compensate for user's arm length. Similarly, the central leg member is vertically adjustable to compensate for a user's height so as to better fit beneath the arm of the user.

In actual use however, the user quickly begins to suffer from discomfort due to the pressure exerted against the underarm area of a user, and, in particular, against the brachial artery, as well as the ulnar, radial and median nerves. As a result, many users place excessive force on their hands in an attempt to alleviate some of the pain and discomfort being generated beneath the arms. Soon thereafter, discomfort is felt in the hands. This often leads to users who completely disregard the crutch and attempt to walk without it, thus further aggravating their injuries. Furthermore, it is typically impossible for the user of a conventional crutch to carry accessories such as a briefcase or a beverage container. Others become victims of accidents while using conventional crutches due in part to the instability generated by such a small peg-like tip making the only contact with the ground.

In order to continue performing their jobs, or to get through everyday living, users frequently need to carry a newspaper, documents, notepads, briefcases, beverages, and the like. Crutch users have considerable difficulty carrying such articles by hand while simultaneously supporting themselves on a pair of crutches because the user must grasp and lean on each handgrip in order to manipulate the crutch. While temporarily confined to crutches, users need a method of transporting accessories. Accordingly, there is a need for crutches which alleviate some of the discomfort experienced in the underarm area of a user, provide more secure footing on the ground, and allow the attachment of accessories to the crutch.

Many attempts have been made in the past to improve conventional crutches. For example U.S. Pat. No. 2,383,786 issued on Aug. 28, 1945 to Gish discloses a crutch which uses a plurality of separable members so that it may be readily assembled and disassembled. The crutch allows the distance between the support for the arm pit and the hand grip, as well as the distance between the hand grip and the lower end of the crutch, to be varied.

U.S. Pat. No. 4,289,156 issued on Sep. 15, 1981 to Ulics discloses a crutch attachment in the form of a container which can be readily mounted to a conventional crutch without forming any new holes which may compromise the strength of the crutch. The container comprises a one-piece high impact resistance plastic tray which has a pair of tabs spaced a distance accommodating the length between the side rails of the crutch. The tabs receive the bolts which fasten the crutch handle to the side rails. The container may be provided with a pair of internal vertical ridges for receiving and wedging a standard beverage container in an upright position.

U.S. Pat. No. 4,295,483 issued on Oct. 20, 1981 to Smith discloses an accessory pouch mounting for a crutch. The pouch includes a central cavity for carrying small articles and has attached exterior pockets for separately carrying additional items. A plurality of exterior loops are provided so that larger bundles may be tied to the accessory pouch. The pouch is formed from a snug-fitting fabric which surrounds the side members of a conventional crutch. A fabric bottom is also provided to close the lower portion of the pouch.

U.S. Pat. No. 5,101,845 issued on Apr. 7, 1992 to Kravetz discloses a carrying device which is attachable to the side of a crutch. The device allows the user to carry thin, flat, non-rigid articles, or a 12 ounce beverage can. The device functions in a clamping manner and has a preloaded spring to firmly hold such articles in place. The device attaches to a conventional crutch by a single bracket at the top which connects to the crutch handgrip bolt by means of a wing nut. An adjustable strap prevents the lower end of the device from pivoting away from or banging against the crutch.

U.S. Pat. No. 5,139,040 issued on Aug. 18, 1992 to Kelly discloses a crutch which may be readily disassembled into a plurality of components capable of being tucked away when not in use. The components can be adjusted to accommodate users of different heights. The crutch includes a plurality of parts which telescopingly engage each other. The parts are also provided with registering apertures. The apertures function in conjunction with a release pin assembly in order to allow the relative position of the engaged parts of the crutch to be changed, thereby varying the overall length of the crutch to suit different users.

U.S. Pat. No. 5,482,070 issued on Jan. 9, 1996 to Kelly discloses a convertible crutch/cane which may be used initially as a crutch and subsequently used as a cane when the need for a crutch is diminished. The crutch/cane includes a connector hand/grip support which eliminates the need for complicated metal working steps. The combined adjustable crutch/cane also features an underarm support, which includes an anti-rotation feature which makes it useful as a single support crutch.

United Kingdom Patent No. 122,694 discloses an improved crutch capable of being collapsed or compressed so that it may be conveniently stowed away or packed into a suitcase when traveling. The crutch comprises two or more tubular sections which are arranged in a telescoping manner. The sections are designed to be independent, but are connected together by spigot and socket joints.

None of the prior art is seen to describe the present invention as claimed. Accordingly, a crutch which alleviates some of the discomfort experienced in the underarm area of a user, provides more secure footing on the ground, and allows the attachment of accessories to the crutch would be beneficial.

OBJECTS AND SUMMARY OF THE INVENTION

Accordingly, it is an object of this invention to overcome the disadvantages of the prior art.

It is another object of this invention to provide a crutch having a ground engaging foot which provides improved stability.

It is yet another object of this invention to provide a crutch having a shoulder support capable of comfortably supporting a user.

It is a further object of this invention to provide a crutch capable of supporting and transporting accessory items.

It is a still further object of this invention to provide a crutch which is fully adjustable, lightweight, compact in design, and easy to assemble.

In accordance with the objects of this invention, a crutch is provided for use by individuals who have been injured or are physically challenged. The crutch includes an upper telescoping element, a lower telescoping element, a shoulder support, a handle, and a foot. The upper telescoping element has a hollow interior and includes an upper portion, a lower portion, and two sides. Each of the sides of the upper telescoping element contain a number of apertures. The lower telescoping element is capable of being inserted into the upper telescoping element. The lower telescoping element also includes an upper portion, a lower portion, and two sides. Each side of the lower telescoping element also contains a plurality of apertures. The position of the lower telescoping element may be varied within the upper telescoping element in order to accommodate the height of the user. Once adjusted to the approximate height desired, the apertures of the upper telescoping element and the lower telescoping element are aligned and means are provided to secure them in such relation. The shoulder support is secured to the upper portion of the upper telescoping element so as to provide a comfortable resting surface for the underarm of the user. The handle may be adjusted based on the arm length of the user and then appropriately secured to the upper telescoping element. The foot of the crutch has a rectangular cross-section which allows it to make a more effective contact with the terrain on which the user is traversing.

In accordance with another object of the invention the crutch is provided with means for supporting accessories. The means for supporting accessories includes an accessory mount having two extension sides which are integrally connected to it. Each of the extension sides contain at least one aperture which allows the accessory mount to be removably secured to either the upper telescoping element or the lower telescoping element. Various accessory items such as a beverage container, an accessory pack, or a briefcase may be removably attached to the accessory mount.

In accordance with another object of the invention, the crutch is provided with a shoulder support which is specifically molded to fit beneath the shoulder of a user. The shoulder support is constructed of cushioning materials which absorb some of the pressure exerted underneath the shoulder of a user. The shoulder support also has a convex contour, which minimizes pressure against the brachial artery, as well as the ulnar, radial, and median nerves beneath the shoulder of the user. In a preferred embodiment of the invention, the shoulder is constructed of cushioned urethane foam or other material of similiar characteristics in order to comfortably support the user.

The above and many other objects, features, and advantages of this invention will be better understood from the ensuing description of selected preferred embodiments, which should be read in conjunction with the accompanying drawings.

DESCRIPTION OF THE PREFERRED EMBODIMENTS

Figure 1:
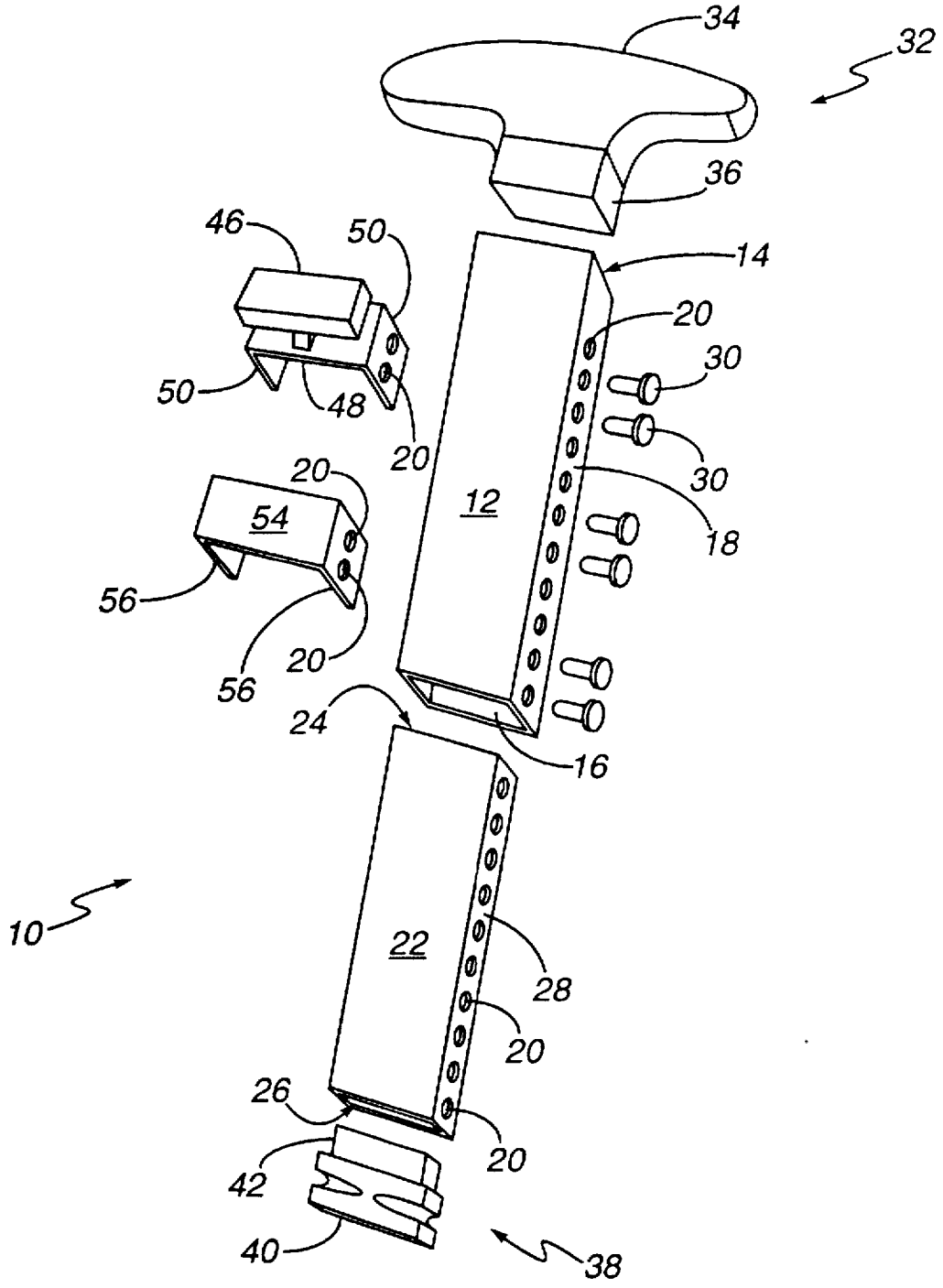
FIG. 1 is an exploded perspective view of the crutch of the present invention.

With reference to the drawings, and initially to FIG. 1, there is shown a crutch 10 in accordance with the present invention. Crutch 10 includes an upper telescoping element 12 and a lower telescoping element 22 which are capable of acting in concert to adjust the height of crutch 10.

The upper telescoping element 12 has an elongated shape and a hollow interior. The upper telescoping element 12 includes a first opening 14, a second opening 16, and two sides 18. Each of the two sides 18 contains a plurality of apertures 20 disposed therein. The apertures 20 are positioned on a straight path along sides 18 of upper telescoping element 12. Apertures 20 are spaced apart, by a predetermined distance, and, most preferably, equally spaced apart.

Lower telescoping element 22 has an elongated shape with a cross-section similar to that of upper telescoping element 12. Lower telescoping element 22 is designed such that it is capable of being inserted within upper telescoping element 12, thereby allowing lower telescoping element 22 to be rigidly coupled to upper telescoping element 12. The cross-sectional area of lower telescoping element 22 represents only a slight reduction from that of upper telescoping element 12 so as to allow maximum rigidity when upper and lower telescoping elements 12 and 22, respectively, are coupled. Lower telescoping element 22 includes a first end 24, a second end 26, and two sides 28. Each side 28 contains a plurality of apertures 20 positioned along a straight path on sides 28. Apertures 20 which are disposed on sides 28 of lower telescoping element 22 are spaced apart by the identical distance which spaces the apertures of upper telescoping element 12. Lower telescoping element 22 may be inserted into and adjusted within the upper telescoping element 12 via alignment of the apertures 20 contained in the lower and upper telescoping elements 22, 12, respectively. Once the apertures 20 are properly aligned, fasteners 30 may be used to detachably couple upper and lower telescoping elements 12, 22, respectively so that they effectively function as a single unit.

Upper and lower telescoping elements 12, 22 respectively, may be constructed of any high strength material such as metals, alloys, composites, wood, and plastics. While metals and alloys offer high strength, additional benefits may be gained by using composites and high-strength plastics. These materials provide sufficient strength for allowing crutch 10 to support an individual, while simultaneously reducing the weight of crutch 10. In order to further reduce the weight of crutch 10, lower telescoping element 22 may be designed with a hollow interior. There are also a variety of fasteners 30 which may be used to detachably couple upper and lower telescoping elements 12, 22, respectively, such as screws, a combination nut and bolt, or a combination wingnut and bolt.

Figure 3:
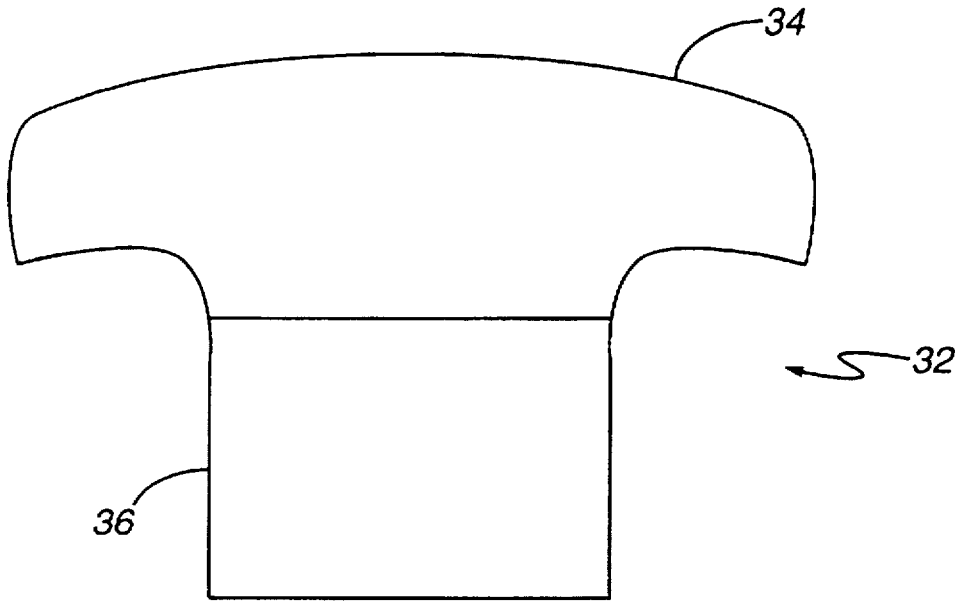
FIG. 3 is an enlarged front elevational view of the shoulder of the crutch.

A shoulder support 32 is removably inserted into first opening 14 of upper telescoping element 12 and provides underarm support for the user of crutch 10. As seen more particularly in FIG. 3, shoulder support 32 includes a top portion 34 and a fitted extension 36 which is integral with top portion 34. Fitted extension 36 is designed such that it may engage the hollow interior of upper telescoping element 12 in a secure fashion. For purposes of assembling crutch 10, fitted extension 36 has a cross-sectional diameter which is similar to that of upper telescoping element 12, but properly reduced to provide a frictional fit within first opening 14 thereof. Top portion 34 of shoulder support 32 has a generally convex shape. This is in contrast to the concave shape provided by traditional crutches. The concave shape of the prior art has tended to exacerbate of problem of pressure being exerted against the brachial artery, as well as certain of the nerves beneath the arm of a user. The convex shape, however, allows shoulder support 32 to fit more comfortably beneath the underarm of a user and ameliorate the user's discomfort experienced thereat by minimizing the pressure exerted against the brachial artery, as well as the ulnar, radial and median nerves beneath the shoulder, when all or a portion of the user's weight is being supported by crutch 10. Improved comfort may be provided by molding the top portion 34 from cushioning materials such as urethane foam.

Figure 4:
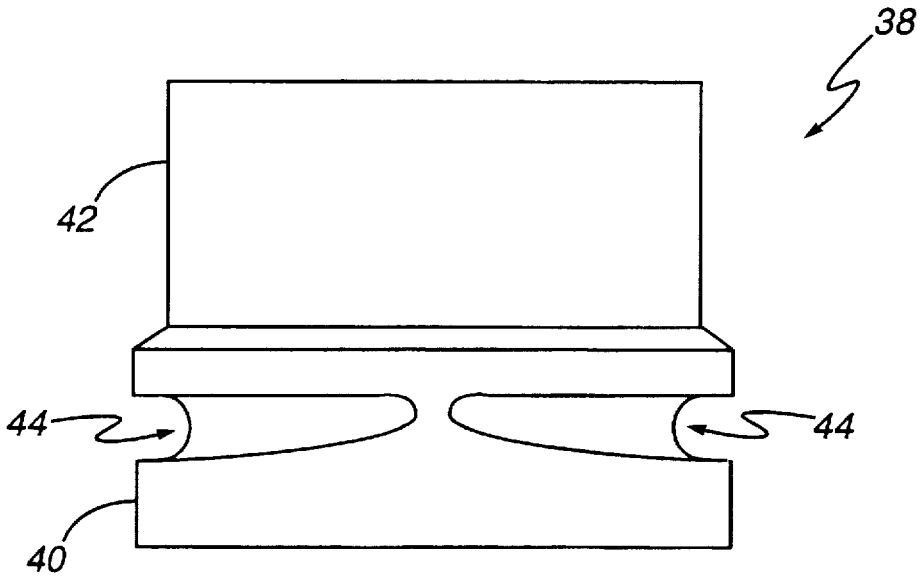
FIG. 4 is an enlarged front elevational view of the foot of the crutch.

A foot 38 is attached to second end 26 of lower telescoping element 22 and serves to provide a contact surface for crutch 10 with the terrain being traversed. With continued general reference to FIG. 1 and specific reference to FIG. 4, foot 38 is shown to include a sole 40 and a fitted top 42. It is preferred that sole 40 be provided with a rectangular cross-section so as to provide a more stable contact with the ground. A plurality of wedge shaped notches 44 are peripherally disposed on the surface of sole 40. Wedge shaped notches 44 allow sole 40 to flex in a manner similar to that of a human ankle during operation. Fitted top 42 is integral with sole 40 and designed with a cross-section similar to that of lower telescoping element 22. Fitted top 42 is capable of engaging lower telescoping element 22 in a frictionally secure manner. If lower telescoping element 22 is designed with a hollow interior, then fitted top 42 may be inserted within the interior of second end 26 thereof. If lower telescoping element 22 is designed as a solid unit, then a corresponding cavity must be provided to receive fitted top 42 of foot 38. It is preferred that foot 38 be composed of shock absorbing materials such as rubber.

A handle 46 is provided which may be adjustably attached to upper telescoping element 12. Handle 46 allows a user to rest on shoulder support 32 while transferring the bulk of the user's weight to handle 46 via the user's hand. Handle 46 is integrally connected to a base 48 and offset therefrom. A pair of attachment plates 50 extend from base 48. Each of the individual attachment plates 50 includes at least one and, most preferably, a pair of apertures 20 therein. Apertures 20 are spaced apart at a distance identical to that of apertures 20 of upper and lower telescoping elements 12, 22, respectively. Base 48 is sized such that attachment plates 50 are capable of fitting snugly about the sides 18 of upper telescoping element 12. Base 48 may be adjusted so that handle 46 may appropriately accommodate the arm length of a user. This is done by aligning apertures 20 of attachment plates 50 with apertures 20 of upper telescoping element 12 and securing attachment plates 50 with appropriate fasteners 30.

Figure 2:
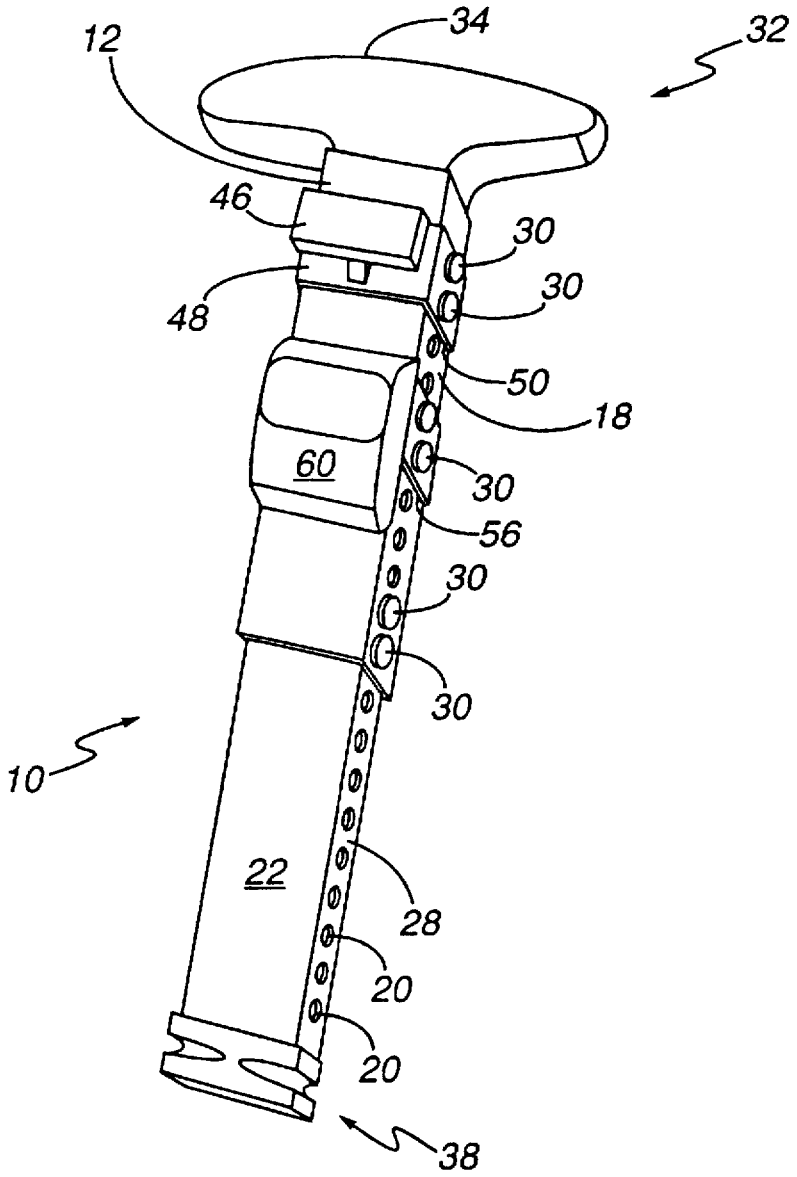
FIG. 2 is a perspective view of the crutch with an accessory pack attached thereto.

As shown in FIG. 2, crutch 10 of the present invention is shown with an accessory pack 60 attached thereto. As described above, crutch 10 includes upper telescoping element 12 and lower telescoping element 22, which act in concert to adjust the height of crutch 10. An accessory mount 54 (FIG. 1) is used to secure accessory pack 60 to crutch 10.

As shown in FIG. 1, accessory mount 54 includes two extension sides 56 which contain apertures 20 therein. Apertures 20 are spaced apart at a distance identical to that of apertures 20 contained in upper and lower telescoping elements 12, 22, respectively. Accessory mount 54 is sized such that extension sides 56 are capable of fitting snugly about the sides 18 of upper telescoping element 12. Accessory mount 54 may then be positioned so that it's apertures are in alignment with apertures 20 of either upper or lower telescoping elements 12 and 22, respectively. Once positioned, appropriate fasteners 30 are used to secure accessory mount 54 to crutch 10. In order to carry items such as accessory pack 60 (FIG. 2) on crutch 10, means are provided for securing such items to accessory mount 54. Such means include, but are not limited to, Velcro® strips. Alternatively, means for supporting the items to be carried may be integral to accessory mount 54.

It will be appreciated by those skilled in the art that there are various modifications which may be made to the disclosed embodiments. For example, there are numerous materials which can be used to construct the various parts of the crutch while maintaining the above described features. Also, there are various other ways of attaching the shoulder support to the upper telescoping element. For example, a plurality of apertures may be provided in the fitted extension of the shoulder support, thereby allowing alignment with the apertures in the upper telescoping element. Fasteners could then be used to secure the shoulder support in place. Similarly, the fitted top of the foot may be provided with apertures capable of being placed in alignment with the apertures of the lower telescoping element, so that a fastener may be used to secure the foot to the lower telescoping element. Alternatively, the shoulder support and the foot may be provided with hollow interiors, thereby allowing the upper and lower telescoping elements to be respectively inserted therein. Finally, there are numerous accessories which may be secured to the crutch. These include but are not limited to a bag, a briefcase, or a beverage container. It will also be appreciated that multiple accessories may be carried on an individual crutch. Moreover, the means for securing the accessories to the accessory mount can include Velcro® strips or means integral to the accessory mount.

While the invention has been described with reference to selected preferred embodiments, it should not be limited to those embodiments. Rather, many modifications and variations will become apparent to those skilled in the art without departure from the scope and spirit of this invention as defined in the appended claims.

What is claimed is:

1. A crutch, comprising:

a shoulder support;

a longitudinal element having an upper end and a lower end, said upper end of said longitudinal element receiving said shoulder support;

a handle adjustably attached to said longitudinal element;

means for adjustably attaching said handle to said longitudinal element; and a flexible foot attached to the lower end of said longitudinal element, said foot having a sole, said sole having a plurality of wedge shaped notches, each of said notches having an apex and being disposed horizontally.

2. The crutch of claim 1, wherein the apex of the notch is directed towards the center of the sole.

3. The crutch of claim 1, wherein said foot is composed of a shock absorbing material.

4. The crutch of claim 3, wherein said shock absorbing material is rubber.

5. The crutch of claim 1, wherein said longitudinal element comprises a plurality of telescoping elements.

6. The crutch of claim 5, wherein said longitudinal element comprises:

an upper telescoping element having a first end and a second end, said first end of said upper telescoping element receiving said shoulder support;

a lower telescoping element having a first end and a second end, said first end of said lower telescoping element receiving said second end of said upper telescoping element; and means of adjustably securing said first end of said lower telescoping element to said second end of said upper telescoping element.

7. The crutch of claim 6, wherein said upper telescoping element, said lower telescoping element and said sole are generally rectangular in shape.

8. The crutch of claim 7, wherein said upper telescoping element has a hollow interior and includes two opposite sides, each of said sides of said upper telescoping element containing a plurality of apertures spaced apart at predetermined increments;

said lower telescoping element insertably engages said upper telescoping element and includes two opposite sides, each of said sides of said lower telescoping element containing a plurality of apertures spaced apart at predetermined increments so as to provide variable alignment with said apertures of said upper telescoping element; and said means for adjustably securing said lower telescoping element to said upper telescoping element comprises at least a first fastener and a second fastener, the first fastener being positioned on one side of said upper telescoping element and the second fastener being positioned on the opposite side of said upper telescoping element, and each of said first and second fasteners being inserted into one of said apertures in said upper telescoping element and extending into a registering aperture in said lower telescoping element thereby securing said upper telescoping element to said lower telescoping element at a desired height.

9. The crutch of claim 8, wherein said handle is attached to the upper telescoping element, and said means for adjustably attaching said handle to said upper telescoping element comprises:

a base integrally connected to said handle;

a pair of attachment plates integrally attached to the opposite ends of said base, each of said attachment plates containing at least one aperture, said pair of attachment plates fitting snugly about each opposite side of said upper telescoping element so that the apertures of the attachment plate are aligned with the apertures of the upper telescoping element; and a plurality of fasteners for securing said attachment plates to said upper telescoping element.

10. The crutch of claim 8, further comprising means for mounting accessories.

11. The crutch of claim 10, wherein said means for mounting accessories comprises:

an accessory mount;

a pair of extension plates integrally attached to the opposite ends of said accessory mount, each of said extension plates containing at least one aperture, said pair of extension plates fitting snugly about each opposite side of said upper telescoping element so that the apertures of the extension plates are aligned with the apertures of the upper telescoping element; and a plurality of fasteners for securing the extension plates to the upper telescoping element.

12. The crutch of claim 10, wherein the means for mounting accessories comprises:

an accessory mount;

a pair of extension plates integrally attached to the opposite ends of said accessory mount, each of said extension plates containing at least one aperture, said pair of extension plates fitting snugly about each opposite side of said lower telescoping element so that the apertures of the extension plates are aligned with the apertures of the lower telescoping element; and a plurality of fasteners for securing the extension plates to the lower telescoping element.

* * * * *